US008441410B2

(12) United States Patent
Robert et al.

(10) Patent No.: US 8,441,410 B2
(45) Date of Patent: May 14, 2013

(54) MULTI-ANTENNA SYSTEM FEED DEVICE AND WIRELESS LINK TERMINAL EQUIPPED WITH SUCH A DEVICE

(75) Inventors: Jean-Luc Robert, Betton (FR); Philippe Minard, Saint Medard sur Ille (FR); Ali Louzir, Rennes (FR)

(73) Assignee: Thomson Licensing, Issy les Moulineaux (FR)

( * ) Notice: Subject to any disclaimer, the term of this patent is extended or adjusted under 35 U.S.C. 154(b) by 552 days.

(21) Appl. No.: 12/452,836

(22) PCT Filed: Jul. 22, 2008

(86) PCT No.: PCT/EP2008/059616

§ 371 (c)(1),
(2), (4) Date: Jan. 25, 2010

(87) PCT Pub. No.: WO2009/013297

PCT Pub. Date: Jan. 29, 2009

(65) Prior Publication Data

US 2010/0127951 A1 May 27, 2010

(30) Foreign Application Priority Data

Jul. 24, 2007 (FR) ..... 07 05376

(51) Int. Cl.
*H01Q 21/00* (2006.01)

(52) U.S. Cl.
USPC ..... 343/853; 343/876; 343/893; 343/770

(58) Field of Classification Search ..... 343/770, 343/893, 850, 853, 876, 700 MS
See application file for complete search history.

(56) References Cited

U.S. PATENT DOCUMENTS

| | | | |
|---|---|---|---|
| 5,313,660 A | 5/1994 | Lindenmeier et al. | |
| 6,275,181 B1 * | 8/2001 | Kitayoshi | 342/74 |

FOREIGN PATENT DOCUMENTS

| | | |
|---|---|---|
| DE | 2436647 | 3/1975 |
| EP | 1267446 | 12/2002 |
| GB | 1442014 | 7/1976 |
| WO | WO 92/13399 | 8/1992 |
| WO | WO 02/03498 | 1/2002 |
| WO | WO 02/087096 | 10/2002 |
| WO | WO 2005/086277 | 9/2005 |

OTHER PUBLICATIONS

Database Inspec, The Institution of Electrical Engineers, Stevenage, GB. Feb. 1968, S.B. Cohen: "A class of broadband three-port tem mode hybrids", found in IEEE Transactions on Microwave theory and Techniques US, vol. MTT-16, No. 2, Feb. 1968, pp. 110-116.

(Continued)

*Primary Examiner* — Dieu H Duong
(74) *Attorney, Agent, or Firm* — Tutunjian & Bitetto, P.C.

(57) ABSTRACT

A multi-antenna system feed device and a terminal including such a device is suggested.

Figure 1:
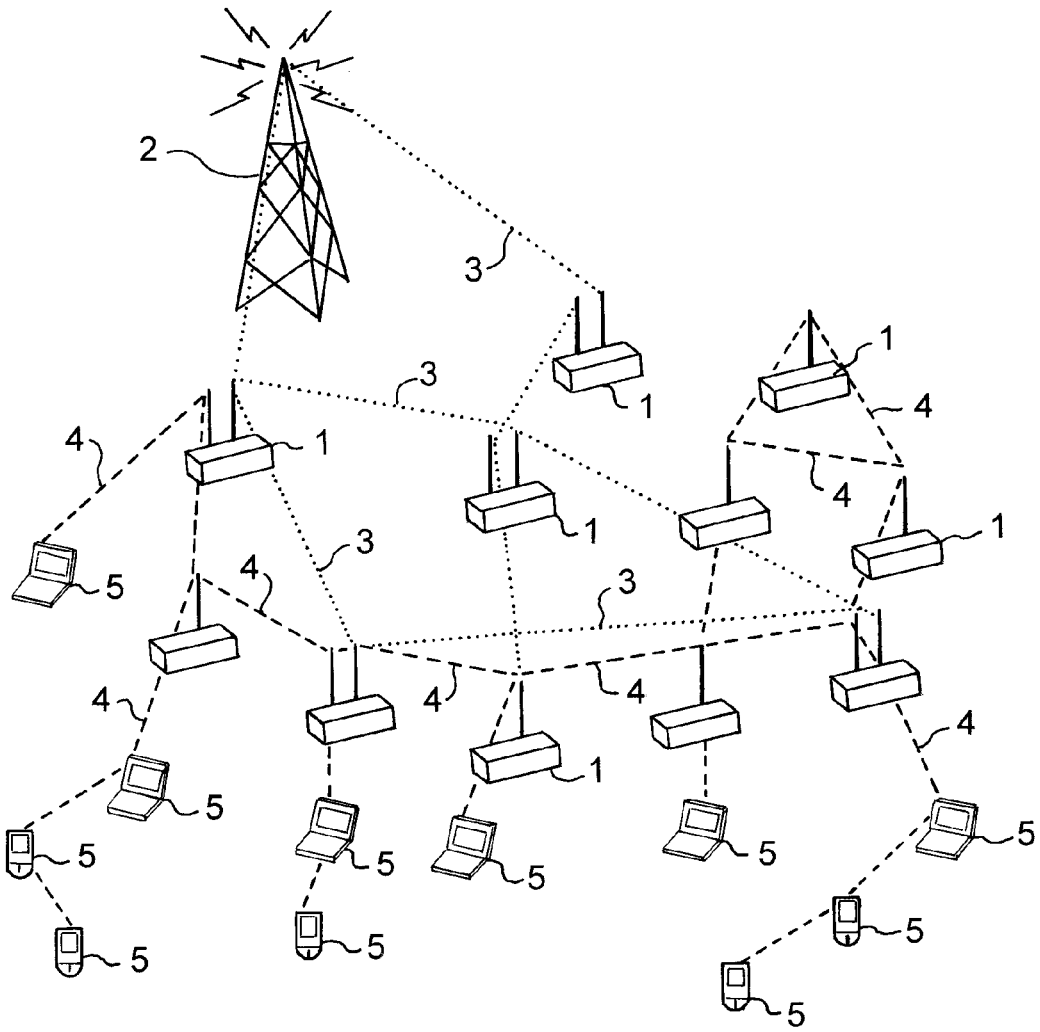

The device includes at least:

- a set of Wilkinson combiners, a branch of a combiner feeding an antenna, with the branches connected as inputs to a feed point;
- a set of switches connected between the antennas and the combiners with each switch switching a combiner branch to its corresponding antenna with the antenna being connected to the line when the switch is closed;

A branch feeding an antenna, for instance, will be common to two consecutive combiners of the system. The suggested multi-antenna system feed device applies in particular to the extension of multi-antenna or sector antenna systems, used especially in devices with Multiple Inputs/Outputs of the MiMo type and more specifically to mesh network architectures.

7 Claims, 4 Drawing Sheets

OTHER PUBLICATIONS

Data Base Inspec, The Institution of Electrical Engineers, Stevenage, GB, Jan. 1960, E.J. Wilkinson: "An N-way hybrid power divider" found in Institute of Radio Engineers transactions on Microwave theory and Techniques US, vol. MTT-8, No. 1, Jan. 1960, pp. 116-118.

D.M. Pozar, "Microwave Engineering" 1990, Wiley, Chapter 8.3 "The Wilkinson Power Divider".

Search Report dated Oct. 24, 2008.

* cited by examiner

MULTI-ANTENNA SYSTEM FEED DEVICE AND WIRELESS LINK TERMINAL EQUIPPED WITH SUCH A DEVICE

This application claims the benefit, under 35 U.S.C. §365 of International Application PCT/EP2008/059616, filed Jul. 22, 2008, which was published in accordance with PCT Article 21(2) on Jan. 29, 2009 in English and which claims the benefit of French patent application No. 07 05376, filed Jul. 24, 2007.

This invention relates to a multi-antenna system feed device and a terminal including such a device. It applies more particularly to the extension of multi-antenna or sector antenna systems, used in particular with multiple input/output devices referred to as being of the MiMo type, an acronym for "Multiple Input—Multiple Output" to standards 802.11 or 802.16. These concepts improve in a noteworthy manner the efficiency of transmission systems by maximizing the capacity of the transmission channels. The invention also applies to mesh networks in which the use of multi-antenna systems permits data to be routed towards the various nodes of the network by the beam forming technique.

Ad hoc mobile networks are defined by a group of mobile nodes connected together through a wireless medium. These nodes can be organized freely in a dynamic manner on their own to create a random and temporary topography of networks referred to as ad hoc, thus allowing people and terminals to interconnect in areas where there is no predefined communications infrastructure.

A new type of network derived from this concept is coming into being. It concerns mesh networks based on a combination of fixed nodes and mobile nodes, interconnected by wireless links.

Many studies are being carried out to improve the capacity of these mesh networks by alternatives using in particular multiple RF (radio-frequency) systems, MiMo techniques or beam shaping antennas. The multiple RF system technique is more especially a way of increasing the network capacity using attenuation, also called fading, independent at various frequencies, with frequency orthogonality. Similarly, multiple antenna systems of the MiMo type, both for transmission and reception, improve the capacity and integrity of wireless links by using antenna diversity and space multiplexing . . . .

Diversity which offers the receiver several responses independent of the transmitted signal is a powerful technique for dealing with interference and fading. Nevertheless, when the interference is at a high level and derives from multiple access, as is the case with a mesh network, the diversity of the antennas alone is not enough to improve the signal.

To deal with interference, smart antennas or adaptative network antennas, to improve radiation efficiency and the possibility of filtering out the sources of interference. To do this, we use antenna beam forming thus generating an effective high gain radiation pattern in the direction of the signal received or transmitted and at low gain in the other directions. Directional transmission control may suffice to ensure high rate transmission with a high level of spatial reuse.

This technique for a mesh network however requires being able to direct the transmitted signal to one or several of the selected antennas while preserving performance in terms of insulation between antennas. This latter constraint is closely linked to the radiation pattern control in a given direction.

The problem that arises does not come from selecting one antenna out of the N antennas, encountered in wireless link systems and generally managed by a more or less comprehensive RF switching device but in particular in the supply and selection of a multi-antenna system, more generally of the multi-sector type, allowing simultaneous signal transmission towards one channel or even N antennas or sectors.

One purpose of this invention is to resolve the problem of isolation between antennas. Accordingly, the purpose of the invention is a multi-antenna system feed system:

- a set of Wilkinson combiners, one combiner branch feeding an antenna with the branches connected to inputs to a feed point;
- a set of switches connected between the antennas and the combiners with each switch switching a combiner branch to its corresponding antenna with the antenna being connected to the line when the switch is closed;

Each combiner consists of two cascade-connected basic Wilkinson combiners, a base combiner comprising a terminal resistance between the quarter-wave lines, an additional line whose length is a multiple of the wavelength being connected between each terminal resistor and each quarter-wave line.

An additional line has, for instance, the same impedance as the quarter wave line.

In an advantageous embodiment, a branch feeding an antenna, for instance, will be common to two consecutive combiners of the system.

For example, each combiner consists of two Wilkinson cascade-connected basic combiners while one branch includes in series the quarter wave lines of the two combiners.

In an advantageous embodiment, the switches are, for instance, non-reflective.

In one possible configuration, in the open state, a switch connects its corresponding branch to an impedance whose value is approximately equal to the characteristic impedance of the combiner.

A switch can be connected to the corresponding antenna by a transmission line having impedance of 50 ohms.

The antennas can be antenna sectors of the same antenna.

For instance, the antenna system consists of Vivaldi type antennas.

In one possible embodiment, the device is located on a two-sided circuit with the first side supporting and forming a first part with:

The antennas;

The switches;

The quarter wave lines of the basic combiners;

The terminal resistors of these combiners;

And on the other side, supporting the following and forming a second part:

The quarter wave lines of the other basic combiner;

The additional lines;

The terminal resistors of these other combiners; links between these sides ensure connection between the two parts.

One purpose of the invention is also having a wireless interconnection terminal equipped with a multi-antenna system having a feed device for the antennas according to any of the previous claims.

Figure 2:
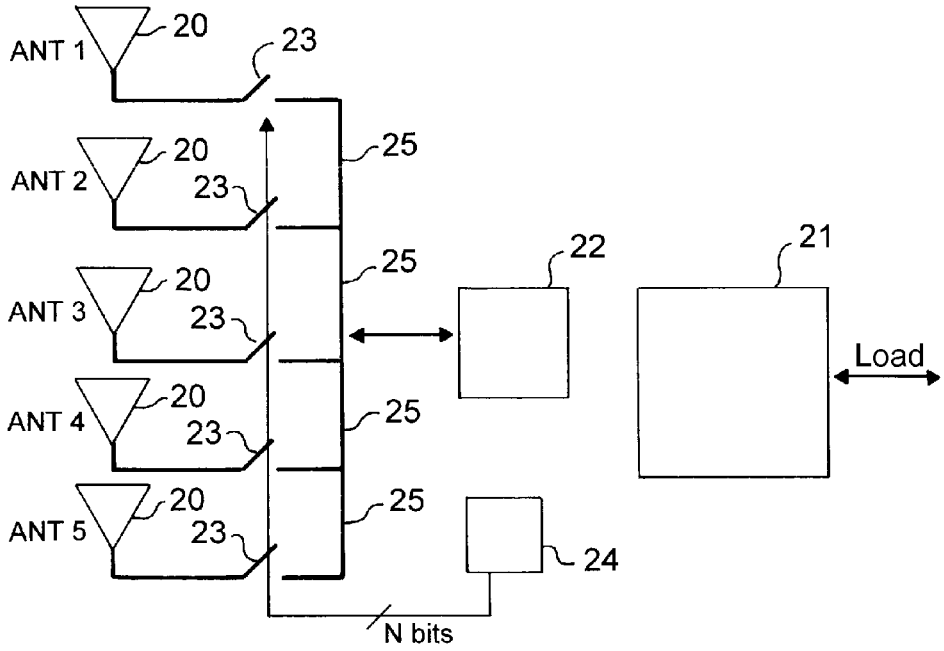
Figure 3:
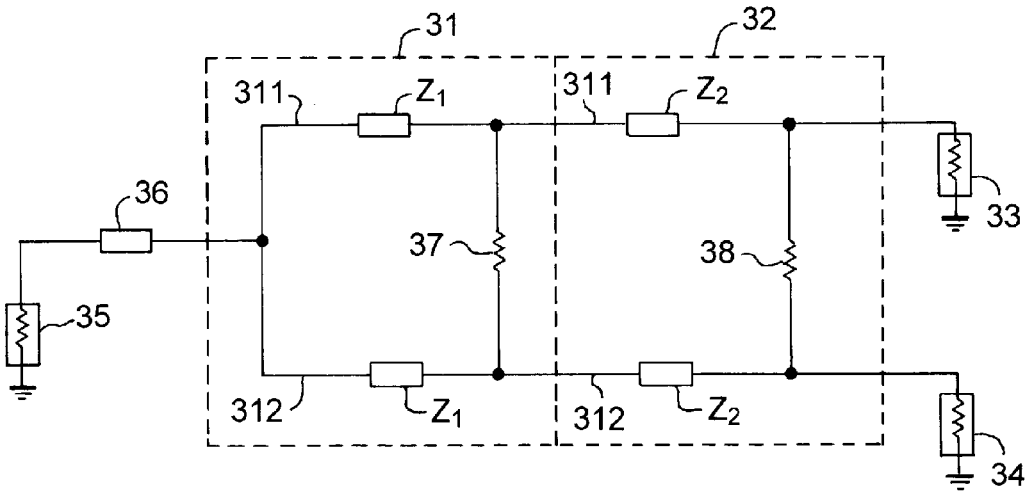
Figure 4:
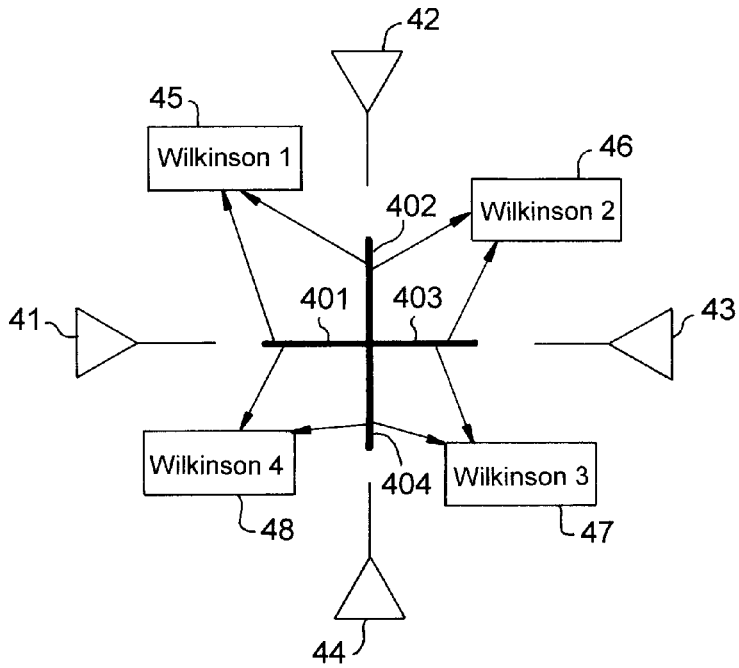
Figure 5:
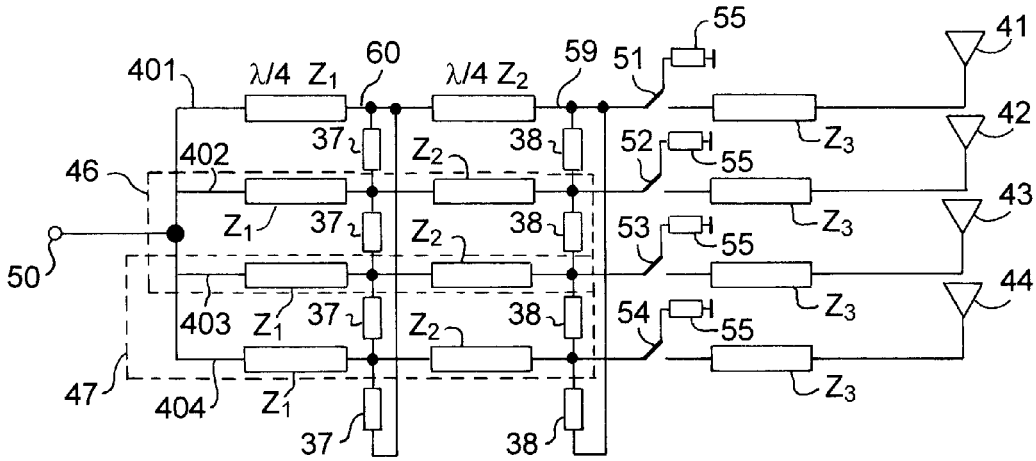
Figure 6:
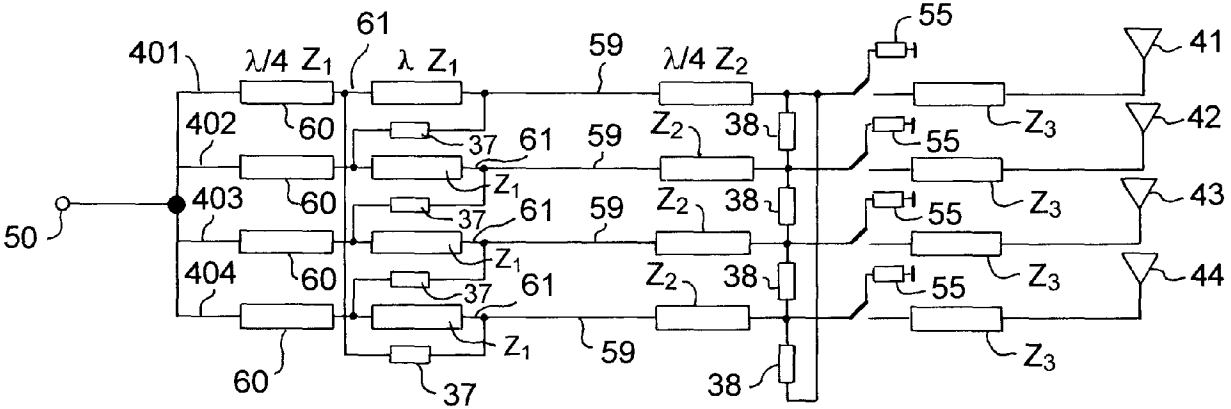
Figure 7B:
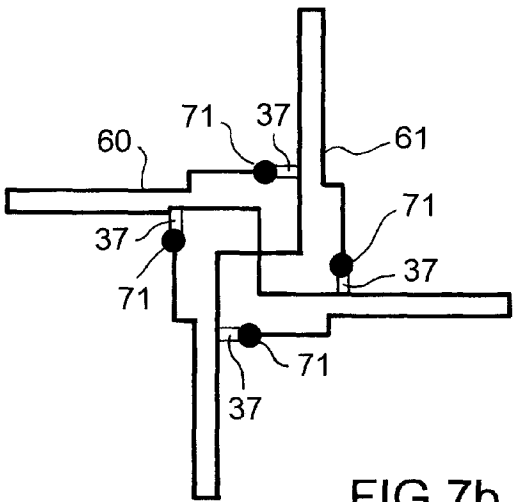
Figure 7A:
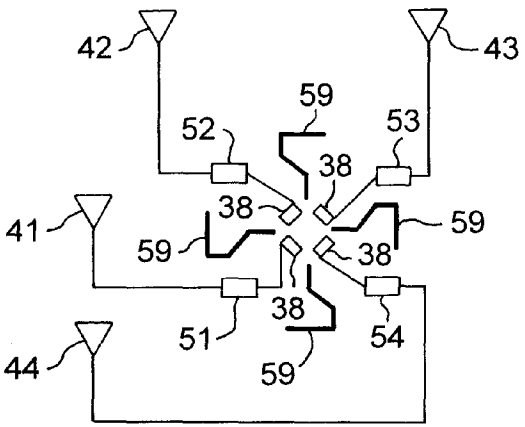

Other characteristics and advantages of the invention will appear from the following description and the attached illustrations representing:

FIG. 1, an example of a mesh network;

FIG. 2, an example of the simplified architecture of a multi-antenna wireless link terminal that can be used in the aforementioned network;

FIG. 3, a typical example of a Wilkinson broadband type combiner;

FIG. 4, a possible use of a Wilkinson type combiner in a device according to the invention;

FIG. 5, an example of the embodiment of a device according to the invention;

FIG. 6, an example of the embodiment of a device according to the invention;

FIGS. 7*a* and 7*b*, an example of the implementation of a device according to the invention.

FIG. 1 illustrates an example of a mesh network using wireless link technologies referred to as WiFi and Wimax. A group of terminals 1 communicates with a transmitter-receiver mounted at the top of a tower 2. These terminals 1 form a set of fixed and mobile nodes. These are terminals devices of the MiMo type operating at standards 802.11 or 802.16. The fixed nodes are connected to the transmitter by a wireless link 3 of the Wimax type to standard 802.16. The mobile nodes are connected together by a wireless link 4 of the WiFi type to standard 802.11. Terminals 5, for instance computers or mobile phones of any type, can also be integrated into the wireless networks 4 of the mobile nodes. As indicated previously, these nodes can self-organize themselves freely in a dynamic manner to create a random and temporary topography of networks referred to as "ad hoc", thus allowing people and terminals 5 to interconnect in areas where there is no predefined communications infrastructure.

FIG. 2 shows a simplified example of the architecture of a multi-antenna wireless link terminal 1 used in particular in the network of FIG. 1. The terminal has transmission and reception antennas 20. It also includes a baseband circuit 21 to standards 802.11 or 802.16, an RF interface circuit conforming to the standards used and an antenna access management device, for transmission or reception, used for directing the signal transmitted on the signal received towards one or several antennas selected simultaneously. For instance, this device includes a series of radio frequency switches 23 and links 25 each connecting an antenna to an RF interface circuit 22. This interface circuit 22 is itself connected to reception and transmission circuits that are also of known types. During transmission, this circuit appears as an RF feed to the antennas. The switches are controlled by a control circuit 24.

It appears that an interface stage inserted between the antenna feed point and the antennas themselves would ensure the necessary criteria of isolation between the antennas and even preserve good matching from the feed standpoint. But whatever technology is used, the penalty for inserting this stage at this precise point of the RF system leads to first to degrading the reception sensitivity by the addition of insertion losses and also in increasing the transmission power to compensate for these losses. These drawbacks lead to thinking in terms of feeding the antenna systems directly from the feed point, that is in star mode. After the optimization of a concept like this, simulation however demonstrated that it is unlikely to hope for isolation of better than around 12 dB between the antennas, far from sufficient to make the most of directivity performance for a mixed type network application, that is with mobile nodes and fixed nodes.

FIG. 3 illustrates a broadband Wilkinson type combiner. More specifically, this combiner is a cascade set-up of two conventional Wilkinson combiners 31, 32. Indeed, the bandwidth of a Wilkinson type combiner can be increased by the cascade connection of two conventional basic combiners. Each basic Wilkinson combiner has two quarter wave transmission lines 311, 312, therefore having length $\lambda/4$, each having a characteristic impedance of $Z_1$ for the first combiner and a characteristic impedance of $Z_2$ for the second combiner. The cascade is produced in such a way that the branches of the second combiner 32 connect like terminal resistors to the branches of first combiner 31. Load resistors 33, 34 are connected to the outputs of the branches of second combiner 32. The input of first combiner 31, forming the input of the overall combiner, is loaded by a third load resistor 35 and is connected to the first combiner through a line including characteristic impedance 36. A terminal resistor 37, 38 is connected between the two branches of each of the basic combiners.

The characteristic impedances of the transmission lines and the terminal resistance values can be optimized to obtain the required isolation in a given frequency band. There is then a trade-off between the isolation performance and the effective bandwidth.

The implementing of a device according to the invention is based in particular on:

- A specific extension of the architecture of a Wilkinson broadband combiner;
- The use of each branch 311, 312 of the combiner on two consecutive antennas or in two consecutive sectors;
- A modulo $\lambda$ unbalance of one of the branches of the combiner allowing the actual setup of the device;
- A switching system for the antennas or sectors of the non-reflective type.

As far as the cascade extension of the combiners is concerned, if we consider this solution for the feeding of two antennas or two consecutive antenna sectors, performance from the standpoint of matching and isolation can be respectively around 20 dB and 30 dB. However, this solution requires the simultaneous feeding of at least four antennas or antenna sectors.

FIG. 4 is a block diagram representing the use of Wilkinson type combiners with respect to the invention. A device according to the invention extends this solution based on broadband Wilkinson combiners to N sectors or antennas by simultaneously using each branch of the combiner both for the sector order n−1 and for the sector order n+1 as illustrated in FIG. 4. The example of FIG. 4 concerns the case of an antenna with four sectors 41, 42, 43, 44 of the Vivaldi type. Considering the first two antenna sectors 41 and 42, they are fed respectively from the central point, not shown, by first branch 401 and second branch 402 of a first Wilkinson type combiner 45. Similarly, second and third sectors 42, 43 are fed simultaneously by first branch 402 and second branch 403 of second combiner 46, with branch 402 feeding second sector 42 being common to first and second combiners 45, 46.

Similarly, third and fourth sectors 43, 44 are fed respectively by first branch before 03 and a second branch 404 of a third combiner 47 and the fourth and first sectors 44, 41 all fed respectively by first branch 404 and second branch 401 of a fourth combiner 48. Branch 403 feeding third sector 43 is common to second and third combiners 46, 47, while branch 404 feeding fourth section 44 is common to third and fourth combiners 47, 48 and branch 401 feeding first sector 41 is common to fourth and first combiners 48, 45. The input of each combiner is also connected to the central feed point. This architecture can be repeated in this way, depending on the numbers of antennas or antenna sectors being used.

FIG. 5 illustrates the principle of antenna or antenna sector switching for architecture of the type shown in FIG. 4. The system of FIG. 5 allows the selection of a signal to be transmitted simultaneously towards one or several antenna sectors 1, 42, 43, 44 thus permitting a modification to the overall radiation pattern according to the network protocol management being used, for instance a network mixing together the fixed terminals and mobile terminals. Therefore, it is important to avoid the least deactivation of one or several simultaneous sectors which could modify the isolation and matching performance of the overall antenna.

According to the invention, antenna switching is carried out behind the feed system based on Wilkinson combiners by a set of selector switches 51, 52, 53, 54 for instance, of the non-reflective types. In particular, this allows:

On the one hand, avoiding any unbalance of the combiner(s) because one or several antenna channels are not deactivated and therefore since one of the branches of this or these combiners no longer see the load presented by the antenna, In addition, remaining almost insensitive to the isolation performance of the set of switches.

The Wilkinson combiners used are of the same type as used in FIG. 3. FIG. 5 shows the four branches 401, 402, 403, 404 feeding respectively the first 41, second 42, third 43 and fourth sectors 44, each branch being common to two consecutive combiners. As an example, two combiners 46, 47 are shown in FIG. 5 whereby the branch 403 feeding the third sector is common to these to combiners. Each combiner 45, 46, 47, 48 is for instance made up of two basic combiners and each branch includes in series the quarter wave lines 60, 59 of the cascade-connected combiners.

Branches 401, 402, 403, 404 are connected at the input to central feed point 50. At the output, each branch is connected to a selector switch 51, 52, 53, 54.

When a switch is open, its corresponding branch is connected to impedance 55 so that the branch is loaded on this impedance 55. To render the selector switch non-reflective for instance, this load impedance 55 equals the characteristic impedance of the combiner, for instance 50 ohms. When a selector switch is closed, it connects its corresponding branch to its antenna or its associated antenna sector, or for instance via a line having characteristic impedance $Z_3$, for instance 50 ohms.

A device as illustrated in FIG. 5 thus preserves in all the active sectors the same isolating performance whatever the switching performed on selector switches 51, 52, 53, 54. Furthermore, this solution makes it possible to maintain a PIRE (Equivalent Radiated Isotropic Power) as a constant by per sector, equal for instance to the power at output 50 of the power amplifier minus 6 dB, to the exclusion of feed circuit losses and the gain of the overall antenna. In particular, this for simply ensuring maximum emitted power per sector 41, 42, 43, 44 while allowing for the regulations and standards in force.

Nevertheless, this solution requires that part of the power transmitted by the power amplifier is absorbed by loads 55 of the non-reflective selector switches. If the amplifier output power is sufficient, this is not constraining and may even simplify the control of the emitted power for mesh network management purposes.

In the reception direction, no loss of sensitivity regarding selector switches 51, 52, 53, 54 needs to be allowed for because the selected antenna sector is directed towards emission point 50.

FIG. 6 illustrates another embodiment that guarantees electrical performance in the frequency spectrums used while providing for practical implementation. Indeed, one difficulty in using a solution of the type shown in FIG. 5 can come from its practical implementation, especially in the frequency field in which 2.4 GHz WiFi band to Wimax applications whose frequency bands are placed respectively at 2.7 GHz, 3.5 GHz or 5.8 GHz, or yet again in WiFi bands in the 5 GHz range.

To obtain optimum behavior from the combiners in these radiofrequency fields, terminal resistors 37 must be located as close as possible to each of the quarter wave transmission lines. Considering, for instance, a Vivaldi type antenna as illustrated in FIG. 4 for an application at 5.8 GHz, the quarter wave line of a combiner measures 7.4 mm. Accordingly, a cross feed 401, 402, 403, 404 as illustrated in FIG. 4, representing for instance the first four quarter wave sections having an impedance $Z_1$ means connecting terminal resistors 37 at the ends of the cross, that is at a distance of approximately 10 mm at 5.8 GHz. Such a distance is particularly prohibitive and considerably degrades the matching and especially the isolation performance, possibly rendering the solution ineffective.

The set up in figure in 6 guarantees electrical performance while ensuring compatibility with an embodiment that can be implemented practically. In this typical embodiment, to minimize the lengths of terminal resistors 37, one of the branches of the combiner is unbalanced by an additional line 61 whose length is a multiple of wavelength λ, having, for instance the same characteristic impedance $Z_1$ as initial branch 60. Accordingly, each terminal resistor 37 is connected between a branch 60 having a length λ/4 and a branch 61 having a length 5λ/4 as illustrated in FIG. 6. This set up is advantageously suited for multi layers circuit, having for instance two layers a front face and a rear face.

FIGS. 7*a* and 7*b* show an example of the implementation of the set up of FIG. 6 on a double sided printed circuit in which FIG. 7*a* shows one face and FIG. 7*b* shows the other. On the first face, illustrated in FIG. 7*a*, the following are located:

Antenna sectors 41, 42, 43, 44, for instance, in the form of patches;

Selector switches 51, 52, 53, 54;

The quarter wave lines 59 of the second basic combiners;

Terminal resistors 38 of these combiners;

On the second side, illustrated in FIG. 7*b:*

Quarter wave lines 61 of the first basic combiner;

Modulo λ 60 length lines equal to wavelength λ in the example shown;

Terminal resistors 37.

Links 71 between these sides ensure connection between the two parts. Measurements have shown that a circuit as illustrated in FIGS. 7*a* and 7*b* produces matching in excess of 20 dB throughout the WiFi band, included in particular between 5.15 GHz and 5.875 GHz with isolation in excess of 30 dB, guaranteeing very good decorrelation between the antenna patterns.

In particular, the invention is ideally suited to multi-antenna systems or multi-sector antennas used in MiMo systems and especially for mesh network architectures. Through its performance in terms of isolation between antennas, the invention will considerably improve the radiation efficiency and the possibility of filtering out interference. Control of directional transmission will thus allow high rate transmission with a high level of spatial re-use.

The typical embodiment presented in the figures includes four antennas or antenna sectors. Naturally, it is possible to apply the invention to a greater number of antennas.

A device according to the invention may be used advantageously to equip a wireless link terminal, for instance of the type shown in FIG. 2. In this case, switches 23 and links 25 system is replaced by a device according to the invention as described previously, connected at the input to interface 22 and at the output to the antennas.

The invention claimed is:

1. A multi-antenna system feed device comprising:

a system of Wilkinson combiners feeding at least four antennas by a branch for each antenna, each branch being connected at one end to an antenna and at the other end to a feed point;

a set of non reflective type switches connected to the antennas, each switch switching a branch to its corresponding antenna, the antenna being connected to the branch when the switch is in the closed state, each branch being formed by two quarter wave transmission lines serially connected, first resistances being connected between quarter-wave transmission lines of two consecutive branches, and second resistances being connected between the end points of two consecutive branches.

2. The multi-antenna system feed device according to claim 1, further comprising an additional quarter wave transmission line, serially connected to the other two quarter wave transmission lines of each branch.

3. The multi-antenna system feed device according to claim 1 wherein the antennas are antenna sectors of the same antenna.

4. The multi-antenna system feed device according to claim 1 wherein the antennas are antennas of the Vivaldi type.

5. A wireless link terminal equipped with multi-antenna system comprising the multi-antenna system feed device according to claim 1.

6. The multi-antenna system feed device according to claim 1, wherein the antennas are antenna sectors of the same antenna.

7. The multi-antenna system feed device according to claim 1, wherein the antennas are antennas of the Vivaldi type.

* * * * *